US009347268B2

(12) United States Patent
Grigor et al.

(10) Patent No.: US 9,347,268 B2
(45) Date of Patent: May 24, 2016

(54) SYSTEM AND METHOD TO FACILITATE THE DRILLING OF A DEVIATED BOREHOLE

(71) Applicant: SMITH INTERNATIONAL, INC., Houston, TX (US)

(72) Inventors: Charles Grigor, Houston, TX (US); Shantanu N. Swadi, Cypress, TX (US); Joseph M. Crow, Lafayette, LA (US)

(73) Assignee: Smith International, Inc., Houston, TX (US)

( * ) Notice: Subject to any disclaimer, the term of this patent is extended or adjusted under 35 U.S.C. 154(b) by 538 days.

(21) Appl. No.: 13/723,107

(22) Filed: Dec. 20, 2012

(65) Prior Publication Data

US 2013/0168151 A1 Jul. 4, 2013

Related U.S. Application Data

(60) Provisional application No. 61/582,015, filed on Dec. 30, 2011.

(51) Int. Cl.
*E21B 7/06* (2006.01)
*E21B 23/04* (2006.01)

(52) U.S. Cl.
CPC ..... *E21B 7/061* (2013.01); *E21B 23/04* (2013.01)

(58) Field of Classification Search
CPC ..... E21B 23/04; E21B 23/06; E21B 23/065; E21B 7/061
See application file for complete search history.

(56) References Cited

U.S. PATENT DOCUMENTS

| | | | | |
|---|---|---|---|---|
| 5,109,924 | A * | 5/1992 | Jurgens et al. | 166/117.5 |
| 5,222,554 | A | 6/1993 | Blount et al. | |
| 5,287,921 | A | 2/1994 | Blount et al. | |
| 5,488,989 | A * | 2/1996 | Leising et al. | 166/255.3 |
| 5,697,445 | A | 12/1997 | Graham | |
| 5,725,060 | A * | 3/1998 | Blount et al. | 175/61 |
| 5,740,864 | A * | 4/1998 | de Hoedt et al. | 166/387 |
| 5,775,428 | A * | 7/1998 | Davis et al. | 166/381 |
| 5,826,651 | A * | 10/1998 | Lee et al. | 166/117.6 |
| 5,836,387 | A * | 11/1998 | Carter | 166/217 |
| 5,944,101 | A * | 8/1999 | Hearn | 166/117.5 |
| 5,947,201 | A * | 9/1999 | Ross et al. | 166/298 |
| 6,073,691 | A | 6/2000 | White | |
| 6,092,601 | A | 7/2000 | Gano et al. | |
| 6,135,206 | A * | 10/2000 | Gano et al. | 166/297 |
| 6,209,636 | B1 | 4/2001 | Roberts et al. | |
| 6,454,007 | B1 * | 9/2002 | Bailey | 166/298 |
| 7,156,181 | B2 | 1/2007 | Moore et al. | |
| 7,178,589 | B2 | 2/2007 | Campbell et al. | |
| 7,377,328 | B2 | 5/2008 | Dewey et al. | |
| 7,448,446 | B2 | 11/2008 | Campbell et al. | |

(Continued)

OTHER PUBLICATIONS

"Wireline Perforating Platform," Spec Sheet, Published by Schlumberger, Nov. 2003: pp. 1-2.

(Continued)

*Primary Examiner* — Benjamin Fiorello

(57) ABSTRACT

A system and method for facilitating the drilling of a deviated borehole. The system and method employ a flexible conveyance. A hydraulic actuation assembly is coupled to the flexible conveyance and a whipstock is releasably coupled to the hydraulic actuation assembly. The whipstock and hydraulic actuation assembly are conveyed downhole in the wellbore. The hydraulic actuation assembly provides a hydraulic fluid under pressure to anchor the whipstock.

28 Claims, 6 Drawing Sheets

(56) References Cited

U.S. PATENT DOCUMENTS

| | | | | |
|---|---|---|---|---|
| 7,481,282 | B2 * | 1/2009 | Horst et al. | 175/61 |
| 2002/0066577 | A1 * | 6/2002 | Dewey et al. | 166/382 |
| 2002/0070018 | A1 * | 6/2002 | Buyaert | 166/255.3 |
| 2008/0029276 | A1 * | 2/2008 | Templeton et al. | 166/385 |
| 2008/0078581 | A1 * | 4/2008 | Goodwin et al. | 175/50 |
| 2011/0155468 | A1 | 6/2011 | Gregurek et al. | |
| 2011/0203847 | A1 | 8/2011 | Randall et al. | |
| 2011/0259607 | A1 | 10/2011 | Carisella | |
| 2013/0025864 | A1 * | 1/2013 | Robin | 166/298 |

OTHER PUBLICATIONS

"Production Services Tractor System—A versatile approach to horizontal conveyance," Spec Sheet, Published by Schlumberger, Dec. 2003: pp. 1-8.

"TuffTRAC and TuffTRAC Mono—Cased hole services tractor," Spec Sheet, Published by Schlumberger, 2012: pp. 1-16.

International Search Report and Written Opinion of PCT Application No. PCT/US2012/071245 dated Apr. 22, 2013: pp. 1-14.

European Patent Office, Supplementary European Search Report issued in EP12861366.8 on Mar. 31, 2015, 4 pages, The Hague, Netherlands.

Shawley et al., "Wireline well tractor technology experience in extended reach horizontal wells", Saudi Aramco Journal of Technology, Winter 2010, Dec. 13, 2013, pp. 2-11.

Schlumberger, "Precisely Control Depth and Orientation in Setting Whipstocks", retrieved from http://www.slb.com/-/media/Files/perforating/case_studies/wpp_precisely_cs.pdf, accessed Mar. 19, 2015, published Dec. 31, 2008, 2 pages.

European Patent Office, Communication Pursuant to Article 94(30) EPC issued in EP12861366.8 on Jun. 19, 2015, 5 pages, Netherlands.

* cited by examiner

SYSTEM AND METHOD TO FACILITATE THE DRILLING OF A DEVIATED BOREHOLE

CROSS-REFERENCE TO RELATED APPLICATION

This application claims the benefit of U.S. Provisional Patent Application Ser. No. 61/582,015 filed Dec. 30, 2011, which is incorporated herein by reference in its entirety.

BACKGROUND

Hydrocarbon fluids are obtained from subterranean formations by drilling wellbores. The wellbores are often substantially vertical; however some may be deviated (i.e., non-vertical) to facilitate the recovery of hydrocarbon fluids from the formation. Further, a deviated borehole may be drilled off of a previously drilled wellbore. Drilling of a deviated borehole may be accomplished by placing a whipstock in the wellbore. Once at a desired location downhole, the whipstock is anchored against the surrounding wall surface. The whipstock guides the drill string and the drill bit into a deviated orientation in order to facilitate the drilling of the deviated borehole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A system and method for facilitating the drilling of a deviated borehole are disclosed. In one embodiment, the system includes a flexible line conveyance and a hydraulic actuation assembly coupled to the flexible line conveyance. A whipstock is releasably coupled to the hydraulic actuation assembly, and the whipstock and hydraulic actuation assembly are arranged and designed to be conveyed downhole into a wellbore. The hydraulic actuation assembly provides a hydraulic fluid under pressure to anchor the whipstock.

In another embodiment, the system includes a flexible conveyance and a hydraulic actuation assembly coupled to the flexible conveyance. A whipstock is releasably coupled to the hydraulic actuation assembly, and the whipstock and hydraulic actuation assembly are arranged and designed to be conveyed downhole into a wellbore. The hydraulic actuation assembly provides a hydraulic fluid under pressure to anchor the whipstock at a downhole location and to release the whipstock from the hydraulic actuation assembly.

The method includes conveying by wireline a whipstock downhole into a wellbore. The whipstock is hydraulically anchored in the borehole. The whipstock is then released from the wireline.

BRIEF DESCRIPTION OF THE DRAWINGS

Embodiments of the System and Method to Facilitate the Drilling of a Deviated Borehole are disclosed with reference to the following figures. The same numbers are used throughout the figures to reference like features and components.

DETAILED DESCRIPTION

Figure 1:
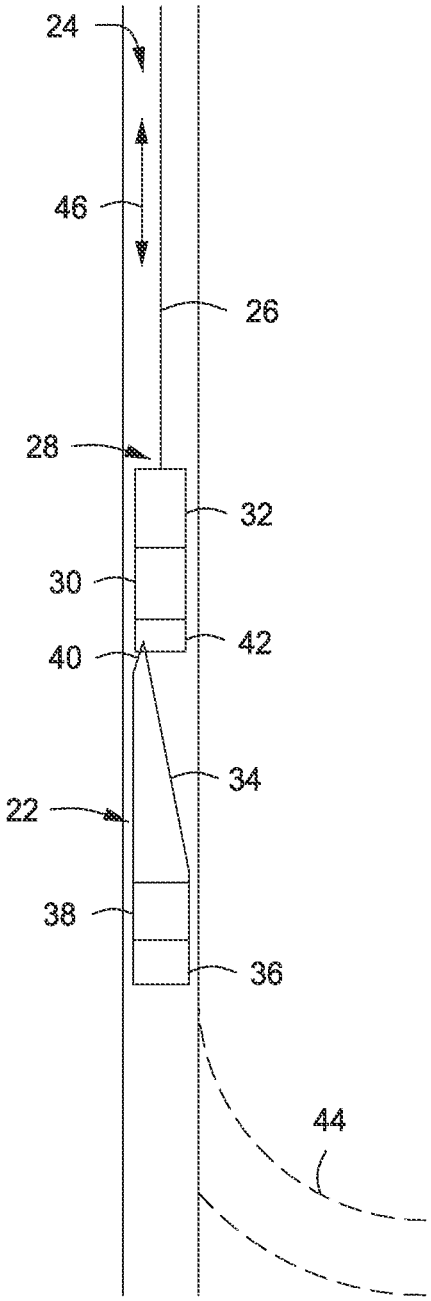
FIG. 1 depicts a schematic view of an illustrative whipstock in a wellbore, according to one or more embodiments disclosed.

The disclosure herein generally involves a system and method to facilitate the drilling of a deviated borehole. The system and method are arranged and designed to provide an efficient approach to deploying a whipstock in a wellbore. As described in greater detail below, the whipstock is a hydraulically-anchored whipstock conveyed downhole on a flexible conveyance. Once positioned at a desired location downhole, actions related to deployment of the whipstock are performed hydraulically to reduce or eliminate the need for placing tensile forces on the flexible conveyance. By way of example, the flexible conveyance may comprise a flexible line conveyance, e.g., wireline, coiled tubing, or other types of flexible conveyances that may be spooled to facilitate deployment and retrieval. In one or more embodiments, the flexible conveyance comprises wireline which may be in the form of a conventional wireline, a multi-conductor wireline cable able to deliver electrical control signals and power signals, a slickline combined with a signal carrier, e.g., LIVE digital slickline services available from Schlumberger Limited, or another suitable form of spoolable wireline.

In one or more embodiments, the whipstock is releasably coupled to the flexible conveyance via a hydraulic actuation assembly which responds to signals, e.g., electrical signals, sent downhole via the wireline or another suitable signal carrier associated with the flexible conveyance. The hydraulic actuation assembly may be designed in a variety of configurations to perform desired actions with respect to the whipstock. For example, the hydraulic actuation assembly may be designed to orient and/or anchor the whipstock. Additionally, the hydraulic actuation assembly may be designed to selectively release the whipstock by, for example, causing shearing of a shear member releasably coupling the whipstock to the hydraulic actuation assembly. The hydraulic actuation assembly also may be designed to disconnect a hydraulic line or lines extending into the whipstock to provide hydraulic fluid for orienting/setting and anchoring the whipstock. The whipstock and the hydraulic actuation assembly may be designed to perform all of these functions, selected individual functions, and/or alternative or additional functions.

The system enables use of a flexible conveyance, such as a wireline or coiled tubing, for deploying a whipstock without placing undue forces on the flexible conveyance. Instead, the forces are generated downhole by the hydraulic actuation assembly. In at least some embodiments, the hydraulic actuation assembly may be a self-contained assembly having a reservoir of hydraulic actuation fluid which is pressurized to perform the downhole functionality. Such a downhole, self-contained hydraulic actuation assembly may be used to eliminate routing of hydraulic control lines down along the flexible conveyance. Pressurization of the hydraulic fluid downhole may be achieved with a variety of systems, such as a downhole pump driven by a downhole motor. In another embodiment, a controlled, explosive reaction can be created to drive a piston or other suitable device able to sufficiently increase the pressure of the hydraulic actuation fluid in a controlled manner over a desired time period. By way of example, the explosive reaction can be created by placing an explosive material, such as a dry explosive or a reactive chemical, in communication with a firing head controlled by electric signals transmitted downhole via the flexible conveyance.

FIG. 1 depicts a schematic view of an exemplary whipstock 22 in a wellbore 24, according to one or more embodiments. The whipstock 22 may include a substantially cylindrical body. A longitudinal axis through the body of the whipstock 22 may be substantially aligned with the longitudinal axis of the wellbore 24. The whipstock 22 may include an inclined surface or plane. The inclined plane may be oriented at an angle with the longitudinal axis of the whipstock 22 ranging from a low of about 1°, about 2°, about 3°, about 4°, or about 5° to a high of about 6°, about 8°, about 10°, about 15°, about 20°, or more. The inclined plane is adapted to cause a drill bit and drill string to diverge from the longitudinal axis of the wellbore 24 and into a sidewall of the wellbore 24. This divergence facilitates the drilling or forming of a deviated borehole 44 off of the wellbore 24. As used herein, "deviated" refers to a borehole that is oriented at an angle to the longitudinal axis of the wellbore 24 (e.g., if the wellbore 24 is substantially vertical, a borehole that is not vertical or is oriented at an angle with respect to vertical). The angle may range from a low of about 1°, about 5°, about 10°, about 15°, or about 20° to a high of about 30°, about 45°, about 60°, about 75°, about 90°, or more. As used herein, wellbore refers to a previously drilled hole and borehole refers to deviated hole drilled from the wellbore. One of ordinary skill in the art will readily recognize that a deviated borehole may in fact be a wellbore, as the term is used herein, if another deviated borehole is drilled therefrom.

The whipstock 22 may be conveyed downhole into the wellbore 24 via a flexible conveyance 26. The flexible conveyance 26 may be or include a line, a tubing, or the like. For example, the flexible conveyance 26 may include coiled tubing or a wireline. The whipstock 22 may be coupled to flexible conveyance 26 via a hydraulic actuation assembly 28. The flexible conveyance 26 may be a multi-conductor wireline adapted to transmit electrical control signals and/or power to the hydraulic actuation assembly 28. The flexible conveyance 26 may also be used to withdraw the hydraulic actuation assembly 28 from the wellbore 24 after the whipstock 22 has been installed and/or released. In FIG. 1, the whipstock 22 is shown being lowered into the wellbore 24 via flexible conveyance 26. To facilitate the drilling of the desired deviated borehole 44, as shown in phantom lines on FIG. 1, the whipstock 22 must be lowered to and anchored at a position corresponding therewith such that the inclined plane 34 of whipstock 22 is properly oriented to facilitate drilling of the desired deviated borehole 44.

The hydraulic actuation assembly 28 may be a self-contained assembly that operates from a downhole location and includes a hydraulic fluid reservoir 30 and a hydraulic fluid pressurizing system 32. The hydraulic fluid pressurizing system 32 is arranged and designed to sufficiently pressurize the hydraulic fluid so as to perform desired functions with respect to the whipstock 22, as described below.

The whipstock 22 may be constructed in a variety of configurations with various functional capabilities. The whipstock 22 may include an inclined plane section 34, a whipstock, an anchoring mechanism 38 and setting mechanism 36. The whipstock 22 also may include a coupling member 40 by which the whipstock 22 is releasably coupled to a corresponding coupling member 42 of hydraulic actuation assembly 28. The coupling member 40 may include a shear member (e.g., a shear pin, a shear groove, or shear threads) that may be selectively sheared to release the whipstock 22 from the flexible conveyance 26 and hydraulic actuation assembly 28.

The anchoring mechanism 38 may include various latches, slips, arms, grips, and/or other features that facilitate securing or anchoring of the whipstock 22 at the desired depth in the wellbore 24 to enable drilling of the deviated borehole 44. An exemplary anchoring mechanism is disclosed hereinafter with reference to FIGS. 9 and 10. While shown in FIG. 1 as being positioned above the whipstock setting mechanism 36, the whipstock anchoring mechanism 38 is not limited to any particular position relative to the whipstock 22 and may be positioned below the whipstock setting mechanism 36, if a whipstock setting mechanism 36 is employed.

While not required for anchoring the whipstock 22, the whipstock setting mechanism 36 may optionally be used to facilitate positioning and/or orienting of the whipstock 22 in the wellbore 24. For example, the setting mechanism 36 may include an orientation device which is arranged and designed to seat with a retaining device. The retaining device may be a packer or seat that has been previously positioned and/or oriented downhole in the wellbore. The orientation device may include a muleshoe, splined stinger or other such coupling that is configured to engage a corresponding member disposed on the retaining device such that the whipstock is rotated/pivoted to the proper orientation and position within the wellbore. In some embodiments, the setting techniques may include one or more of engaging the whipstock 22 with a variety of completion components, landing the whipstock 22 on a seat, latching the whipstock 22, orienting the whipstock 22, and kicking the bottom of the whipstock 22 against the wellbore wall or casing wall.

The whipstock 22 and/or hydraulic actuation assembly 28 may include additional features to aid in the drilling of the deviated borehole 44. For example, a position-sensing device, such as an linear variable differential transformer (LVDT) displacement transducer or a proximity sensor, may be used to measure the displacement of various components (e.g., piston components) of the anchoring mechanism 38 to signal when the anchoring mechanism 38 is anchored (i.e., set in fully anchored position) or to ensure that the whipstock 22 locks in place downhole when the anchoring mechanism 38 is anchored/set. In some applications, the whipstock 22 may include or work in cooperation with other sensor systems, such as a sensor system which records and measures pressure in real time. For example, a pressure sensor or transducer may be coupled to hydraulic actuation assembly 28. The monitoring of pressure in real time may be used, for example, to verify the anchoring of the whipstock 22 through various pressure tests performed in the wellbore 24. Such real time pressure measurement may be transmitted uphole to a surface control system. The pressure may also be recorded downhole, e.g., on a memory chip, for later retrieval.

The hydraulic actuation assembly 28 may also be constructed in a variety of configurations to provide various functional capabilities. The hydraulic actuation assembly 28 may be controlled by signals relayed downhole via a suitable signal carrier, as represented by arrow 46. In some applications, the hydraulic actuation assembly 28 also may be designed to relay data, e.g., pressure data, uphole to a surface control system (not shown). The signal carrier 46 may be part of or combined with the flexible conveyance 26. In one or more embodiments, the signal carrier 46 is an electrical conductor that carries electrical power and/or data signals or is otherwise in electrical communication to allow selective control over the hydraulic actuation assembly 28 (e.g., control over the hydraulic fluid pressurizing system 32). This allows the hydraulic actuation assembly 28 to be self-contained downhole. By way of example, the hydraulic fluid pressurizing system 32 may include a pump driven by a downhole motor to pressurize the hydraulic fluid stored downhole in hydraulic fluid reservoir 30. The hydraulic fluid pressurizing system 32 may also be a firing head coupled with an explosive material which is ignited to cause controlled pressurization of the hydraulic fluid stored downhole in hydraulic fluid reservoir 30.

Figure 2:
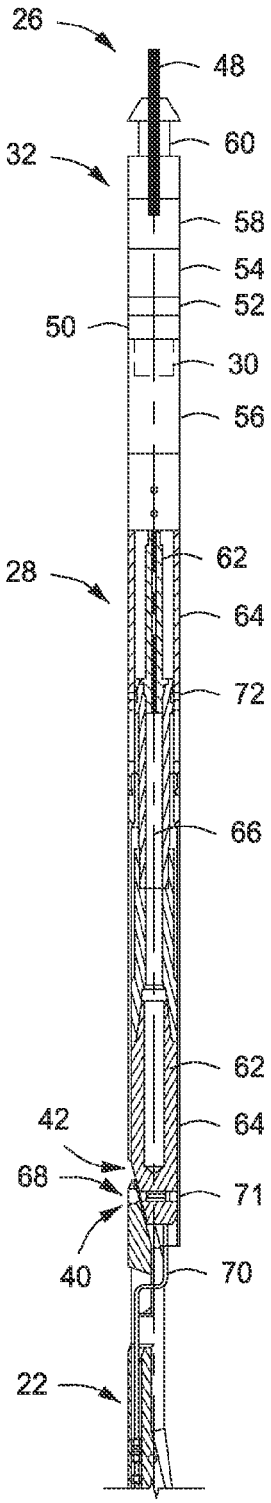
FIG. 2 depicts a partial cross-section view of an illustrative hydraulic actuation assembly for deploying the whipstock in the wellbore via a flexible conveyance, according to one or more embodiments disclosed.
Figure 3:
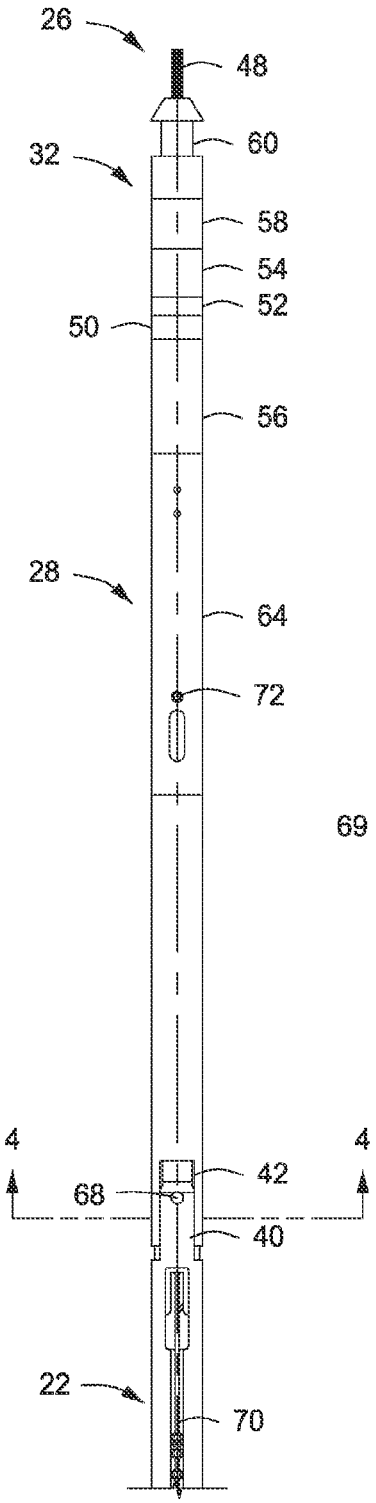
FIG. 3 depicts a partial side view of the hydraulic actuation assembly shown in FIG. 2, according to one or more embodiments disclosed.
Figure 4:
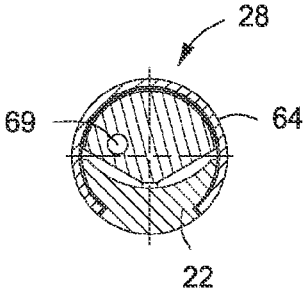
FIG. 4 depicts a cross-section view of the hydraulic actuation assembly taken along line 4-4 in FIG. 3, according to one or more embodiments disclosed.

FIG. 2 depicts a partial cross-section view of an exemplary hydraulic actuation assembly 28 for deploying the whipstock 22 in the wellbore 24 (FIG. 1) via the flexible conveyance 26, FIG. 3 depicts a partial side view of the hydraulic actuation assembly 28, and FIG. 4 depicts a cross-section view of the hydraulic actuation assembly 28 taken along line 4-4 in FIG. 3, according to one or more embodiments. The flexible conveyance 26 may be in the form of a flexible line conveyance 48, such as a wireline, slickline, slickline cable or the like. The hydraulic fluid pressurizing system 32 may include a hydraulic pump 50 powered by a motor 52 that receives electrical current from a suitable power source, such as a downhole power source, e.g., battery, turbine, or via an electrical conductor routed along or as part of the flexible conveyance 26. For example, DC power may be transmitted downhole via the flexible conveyance or be supplied by a downhole battery. Such DC power may then be converted to three phase AC power by a power electronics module 54 for the motor 52. The hydraulic fluid pressurizing system 32 also may include other components, such as a telemetry/communication module 58. A connector 60, such as a rope socket, may be provided as a supplemental connection point for engaging and removing the hydraulic actuation assembly 28.

The motor 52 may be selectively operated to drive the hydraulic pump 50, which pressurizes hydraulic fluid obtained from the hydraulic fluid reservoir 30 and delivers the hydraulic fluid to a separation module 56. In one or more embodiments, the motor 52 is designed to operate at selected, variable speeds so that the whipstock 22 may be anchored at differing rates according to the parameters of a given downhole application. When operated, the motor 52 delivers pressurized hydraulic fluid to the separation module 56 and acts against opposing features (e.g., a piston and cylinder wall) to move an integral, internal mandrel 62 relative to a surrounding integral sleeve 64. Relative movement between the mandrel 62 and the sleeve 64 may occur when the pressure of the hydraulic fluid is between about 500 psi and about 4,000 psi, between about 1,000 psi and about 3,000 psi, or between about 1,500 psi and about 2,500 psi.

However, prior to increasing the pressure of the hydraulic fluid to a level sufficient to cause relative movement between the mandrel 62 and the sleeve 64, the pressurized hydraulic fluid is first delivered down through one or more internal flow passages 66 of the hydraulic actuation assembly 28. The pressurized hydraulic fluid is then delivered through a tubing coupling passage 69 (FIG. 4) which is fluidly coupled uphole to the one or more internal flow passages 66 and downhole to a hydraulic tubing 70 for providing pressurized hydraulic fluid to the whipstock 22 for anchoring and/or orienting.

The pressurized fluid flows from pump 50 down through one or more internal flow passages 66, through tubing coupling passage 68, and through hydraulic tubing 70 to enable performance of a variety of functions with respect to the whipstock 22. For example, the pressurized fluid may be used to anchor or to facilitate anchoring of the whipstock 22 via the anchoring mechanism 38 (FIG. 1) by securing the whipstock 22 at the desired location in the wellbore 24. The pressurized fluid may also be used to orient the whipstock 22 via the whipstock setting mechanism 36 (FIG. 1) at a desired position in the wellbore 24.

As illustrated in FIGS. 2 and 3, the whipstock 22 is releasably coupled to the hydraulic actuation assembly 28 via a release mechanism, such as a shear member 68. The shear member 68, e.g., a shear pin, may be disposed (and coupled) between a coupling member 40 coupled to the whipstock 22 and a corresponding coupling member 42 coupled to the hydraulic actuation assembly 28. For example, shear member 68 (e.g., a shear pin) may extend from or through the coupling member 40 and to or through the corresponding coupling member 42. If the shear member 68 passes through corresponding coupling member 42, such shear member 68 may be received in a corresponding passage 71 of hydraulic actuation assembly 28. A variety of other release mechanisms may be employed to enable selective release of the whipstock 22 from the hydraulic actuation assembly 28. For example, the coupling member 40 and corresponding coupling member 42 may be an integral component that has a shearable notch positioned between the two end portions. Furthermore, various hydraulically actuated release mechanisms (e.g., hydraulically actuated latches, pins, or collets) may be employed to releasably couple the whipstock 22 with the hydraulic actuation assembly 28.

Figure 5:
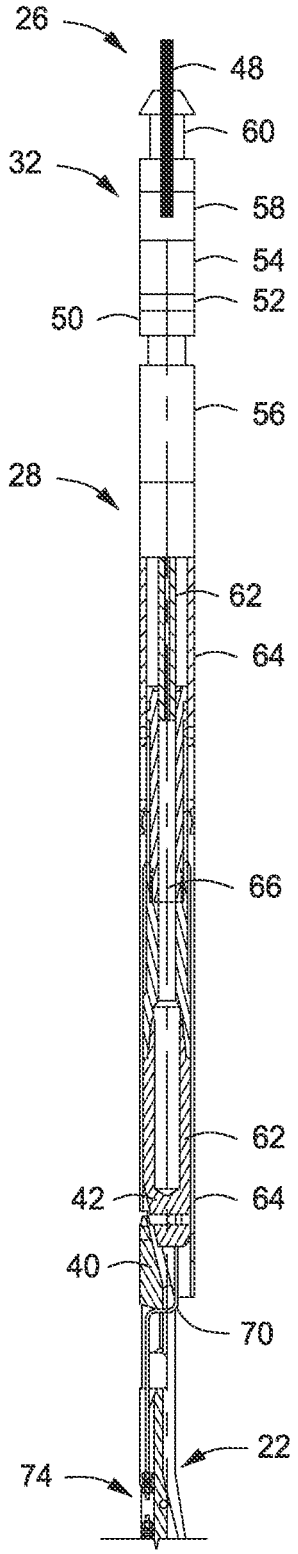
FIG. 5 depicts a partial cross-section view showing a hydraulic actuation assembly hydraulically actuated to a different operational position, according to one or more embodiments disclosed.
Figure 6:
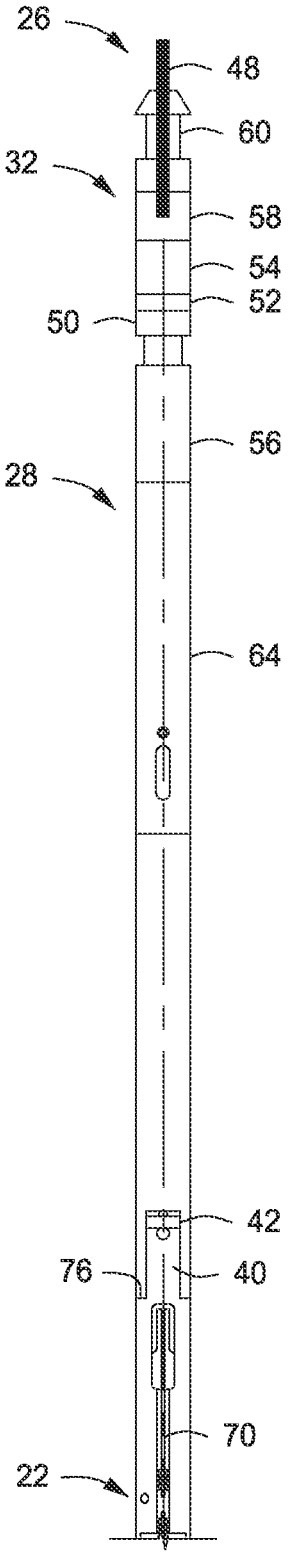
FIG. 6 depicts a partial schematic side view of the hydraulic actuation assembly shown in FIG. 5, according to one or more embodiments disclosed.

FIG. 5 depicts a partial cross-section view of the hydraulic actuation assembly 28 actuated to a different operational position, and FIG. 6 depicts a partial schematic side view of the hydraulic actuation assembly 28 shown in FIG. 5, according to one or more embodiments. Once the whipstock 22 has been anchored/set, the hydraulic fluid pressure may be further increased via the hydraulic fluid pressure system 32 to release the whipstock 22. More particularly, the hydraulic fluid pressure may be increased to cause relative movement between the mandrel 62 and the sleeve 64 in a manner, as disclosed hereinafter, which releases the whipstock 22 from the hydraulic actuation assembly 28. The whipstock 22 may be released when the pressure of the hydraulic fluid is between about 2,000 psi and about 5,000 psi or between about 3,000 psi and about 4,000 psi.

The increased hydraulic pressure acting on mandrel 62 may initially shear one or more shear screws 72, thus allowing the sleeve 64 to shift downward relative to mandrel 62. Continued application of pressure causes additional relative shifting between the mandrel 62 and the sleeve 64 until sleeve 64 engages shoulder 76 of the whipstock 22. Once sleeve 64 engages shoulder 76, continued pressure (and/or increased pressure) by continued the pumping of hydraulic fluid causes mandrel 62 to be moved upward relative to sleeve 64. The upward movement of mandrel 62 relative to sleeve 64 shears the shear member 68, thereby releasing the whipstock 22 from the hydraulic actuation assembly 28. Upward movement of mandrel 62 also causes tubing coupling passage 69 (FIG. 4) and hydraulic tubing 70 to move upwards, thereby separating an upper portion of the hydraulic tubing 70 from a lower portion of the hydraulic tubing 70 at a tubing coupling 74 (e.g., a ferrule connection). Accordingly, the downhole, self-contained hydraulic actuation assembly 28 may be used to perform any one or more or all of the following: orient/set the whipstock 22, anchor the whipstock 22, release the whipstock 22, and/or disconnect the hydraulic tubing 70, without applying tension on the flexible conveyance 26. After releasing the whipstock 22, the hydraulic actuation assembly 28 may be withdrawn from the wellbore 24 via the flexible conveyance 26.

Figure 7:
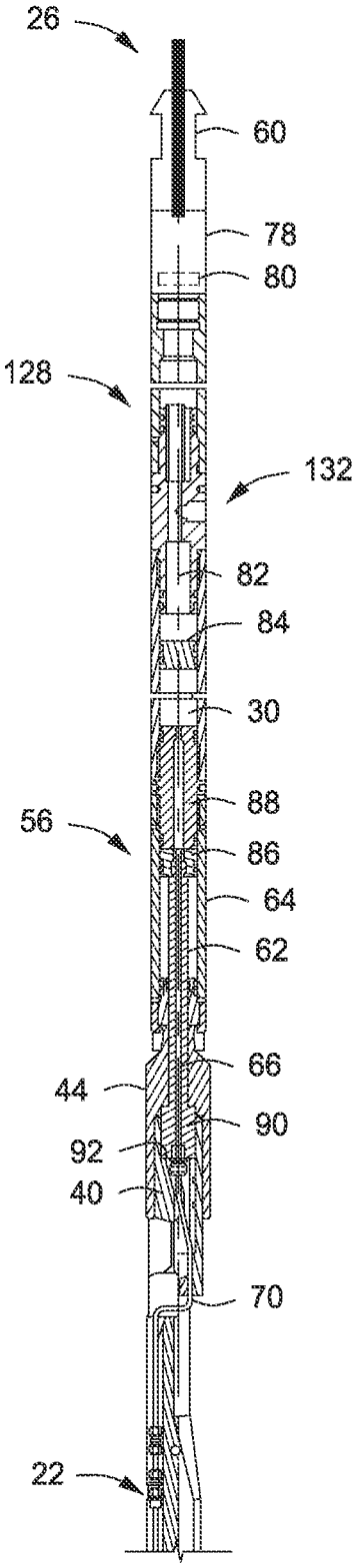
FIG. 7 depicts a partial cross-section view of another illustrative hydraulic actuation assembly for deploying the whipstock in the wellbore via a flexible conveyance, according to one or more embodiments disclosed.
Figure 8:
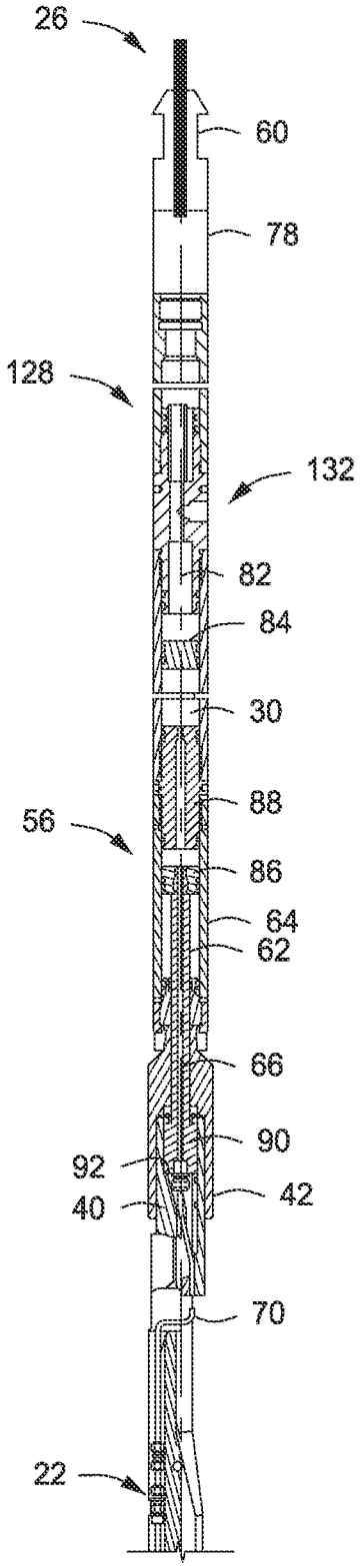
FIG. 8 depicts a partial cross-section view showing the hydraulic actuation assembly of FIG. 7 hydraulically actuated to a different operational position, according to one or more embodiments disclosed.

FIG. 7 depicts a partial cross-section view of another exemplary hydraulic actuation assembly 128 for deploying the whipstock 22 in the wellbore 24 (FIG. 1) via the flexible conveyance, and FIG. 8 depicts a partial cross-section view of the hydraulic actuation assembly 128 of FIG. 7 hydraulically actuated to a different operational position, according to one or more embodiments. The hydraulic actuation assembly 128 uses electrical power supplied via the flexible conveyance 26 or a downhole battery to generate a controlled explosion (e.g., a chemical reaction of an explosive material) which in turn creates a high pressure gas directed to pressurize the hydraulic fluid as part of the hydraulic fluid pressurizing system 132. By way of example, this embodiment of the pressurizing system 132 has a firing head 78 that includes or cooperates with an explosive material 80, as illustrated in FIG. 7. The explosive material 80 may be or include a variety of materials used to create a controlled expansion of gas. For example, the explosive material 80 may be or include a dry charge or a chemical that is induced to undergo a chemical reaction to produce a high pressure gas.

The high pressure gas created by the explosion moves through one or more internal passageways 82 and acts against a floating piston 84. An opposite side of the floating piston 84 acts against the hydraulic fluid within the hydraulic fluid reservoir 30 and pressurizes the hydraulic fluid. As with the previously described embodiments, the pressurized hydraulic fluid may be directed through one or more internal flow passages 66, through tubing coupling passage 69 (FIG. 4), through the hydraulic tubing 70 and to the whipstock 22 for anchoring of the whipstock 22 and/or orienting/locating the whipstock 22 via the whipstock setting mechanism 36 (FIG. 1) at a desired position in the wellbore 24 (FIG. 1).

After anchoring the whipstock 22, the separation module 56 may be used to release the whipstock 22, as further disclosed below. The separation module 56 may include a piston 86 coupled to the mandrel 62, as best illustrated in FIG. 8. The piston 86 is slidably mounted or disposed within the sleeve 64 for movement relative to an internal flow control member 88 coupled to the sleeve 64. As the pressure of the hydraulic fluid is sufficiently increased (e.g., via continued explosive charge detonation or subsequent explosive charge detonation, as disclosed hereinafter), relative movement is caused between the piston 86/mandrel 62 and the member 88/sleeve 64. Similar to the previous embodiment, this relative movement may be used to release the whipstock 22 from the hydraulic actuation assembly 128 and/or to sever the hydraulic tubing 70 prior to withdrawal of the hydraulic actuation assembly 128 via the flexible conveyance 26. A distal abutment end portion 90 of the mandrel 62 may be positioned to abut a shoulder 92 of the whipstock 22 so the relative movement of the mandrel 62 and the sleeve 64 causes shearing (or another type of release) with respect to the release mechanism 68 (see, e.g., FIG. 2) positioned between coupling member 40 coupled to the whipstock 22 and a corresponding coupling member 42 coupled to the hydraulic actuation assembly 28.

The firing head 78, and thus the ignition of explosive material 80, may be controlled by sending control signals (e.g., electrical signals or other types of signals) downhole along the flexible conveyance 26. Upon receipt of the appropriate control signal, the firing head 78 ignites the explosive material 80 to create the high pressure gas that drives the floating piston 84. In some applications, the explosive material 82 is designed to explode in a relatively slow and controlled manner to enable a controlled sequence of functions (e.g., setting the whipstock 22, anchoring the whipstock 22, releasing the whipstock 22, and/or severing the hydraulic tubing 70) without applying tension on the flexible conveyance 26. In one or more embodiments, multiple types of explosive material 82 or multiple charges of explosive material 82 may be arranged to provide a desired chain of reactions.

The whipstock 22 and the hydraulic actuation assembly 28, 128 may include or be used in cooperation with a variety of other components. Additionally, many of the components discussed above may have alternate designs and configurations. For example, the release mechanism 68 may include a variety of latches, pins, collets, locks, and other features that may be hydraulically actuated to release the whipstock 22. Additionally, many types of components may be used to position, orient, set, and/or anchor the whipstock 22 for specific applications. Electrical power may be supplied to the hydraulic actuation assembly 28, 128 via several types of power sources, including but not limited to, downhole batteries, downhole turbines or a multi-conductor wireline cable, which are able to deliver electrical control signals and power to the hydraulic actuation assembly 28, 128.

In one or more embodiments, the hydraulic actuation assembly 28, 128 may also include an orientation system having one or more rotary devices, e.g., motor, gearbox and/or output shaft, to enable an operator or controller to rotationally orient the whipstock 22 and hydraulic actuation assembly 28, 128 to a desired orientation within the wellbore 24 prior to anchoring the whipstock 22. The orientation system may include an anchoring device, e.g., to temporarily hold the position of the hydraulic actuation assembly 28, 128 and whipstock prior to actuating the anchoring mechanism 38. The orientation device may also include a power cartridge or other power source or may be electrically coupled to power electronics module 54. A sensor system may also be incorporated into the whipstock 22 and/or the hydraulic actuation assembly 28, 128 to sense the orientation, i.e., azimuth, of the whipstock 22. By way of example, the one or more sensors, e.g., a gyro, may be designed to sense the orientation of the whipstock 22 relative to a gravitational field and/or relative to a magnetic field. Such orientation data may be transmitted to an operator so that the operator may control the one or more rotary devices to properly rotate/pivot the whipstock 22 and hydraulic actuation assembly 28, 128 prior to anchoring of whipstock 22. Such orientation data may also be communicated directly to a controller controlling the one or more rotary devices to properly rotate/pivot the whipstock 22 and hydraulic actuation assembly 28, 128 prior to anchoring of the whipstock 22. In at least one embodiment, the orientation of the whipstock 22 may be non-hydraulic.

Other types of sensors may also be employed, such as pressure transducers. The use of pressure transducers enables pressure in the hydraulic actuation assembly 28, 128 to be monitored, recorded, and/or transmitted to a surface control system. Such pressure data may also be recorded on a downhole memory device for later retrieval. The pressure data may be used to monitor the whipstock anchoring operation to facilitate proper anchoring of the whipstock 22. This allows an operator to confirm that the whipstock 22 is fully anchored before releasing the whipstock 22 from the hydraulic actuation assembly 28, 128. The pressure data also may be used to check the quality of the whipstock anchoring in real time to enable efficient completion of the whipstock anchoring operation.

Pressure data and/or orientation data may be provided to an internal control system or controller, which operates the one or more rotary devices or other suitable devices to properly orient and/or anchor the whipstock 22 based on data from the sensors. However, the system also may be designed to enable direct commands to be transmitted from a remote user and/or from a remote automated system while also providing sensor data to the remote user and/or the remote automated system.

Control also may be exercised over various other devices designed to facilitate positioning of the whipstock 22 at a desired location in the wellbore 24. For example, a tractor or tractors may be employed to assist conveyance of the whipstock 22 and the hydraulic actuation assembly 28, 128 to a desired location in the wellbore 24, e.g., in a deviated wellbore. The tractors may be or include the TuffTrac and/or the MaxTrac manufactured by Schlumberger Limited. The tractor may be powered from the rig at the surface via a tether and/or powered by downhole batteries. The tractor may be electro-mechanically and/or hydraulically operated. For example, an illustrative tractor is shown and described in U.S. Pat. No. 7,156,181.

Accordingly, the overall well system and method may employ a variety of components coupled in several configurations to facilitate whipstock deployment in differing wells and environments. In one or more embodiments, hydraulic actuating fluid may be delivered at least partially downhole through the wellbore 24. However, the design of the hydraulic actuation assembly 28, 128 enables completely self-contained hydraulic actuation from a downhole position. As discussed above, various types of hydraulic actuation assemblies 28, 128 and pressurizing systems may be used to provide fluid power for carrying out various functions with respect to the hydraulically anchored whipstock 22.

Figure 9:
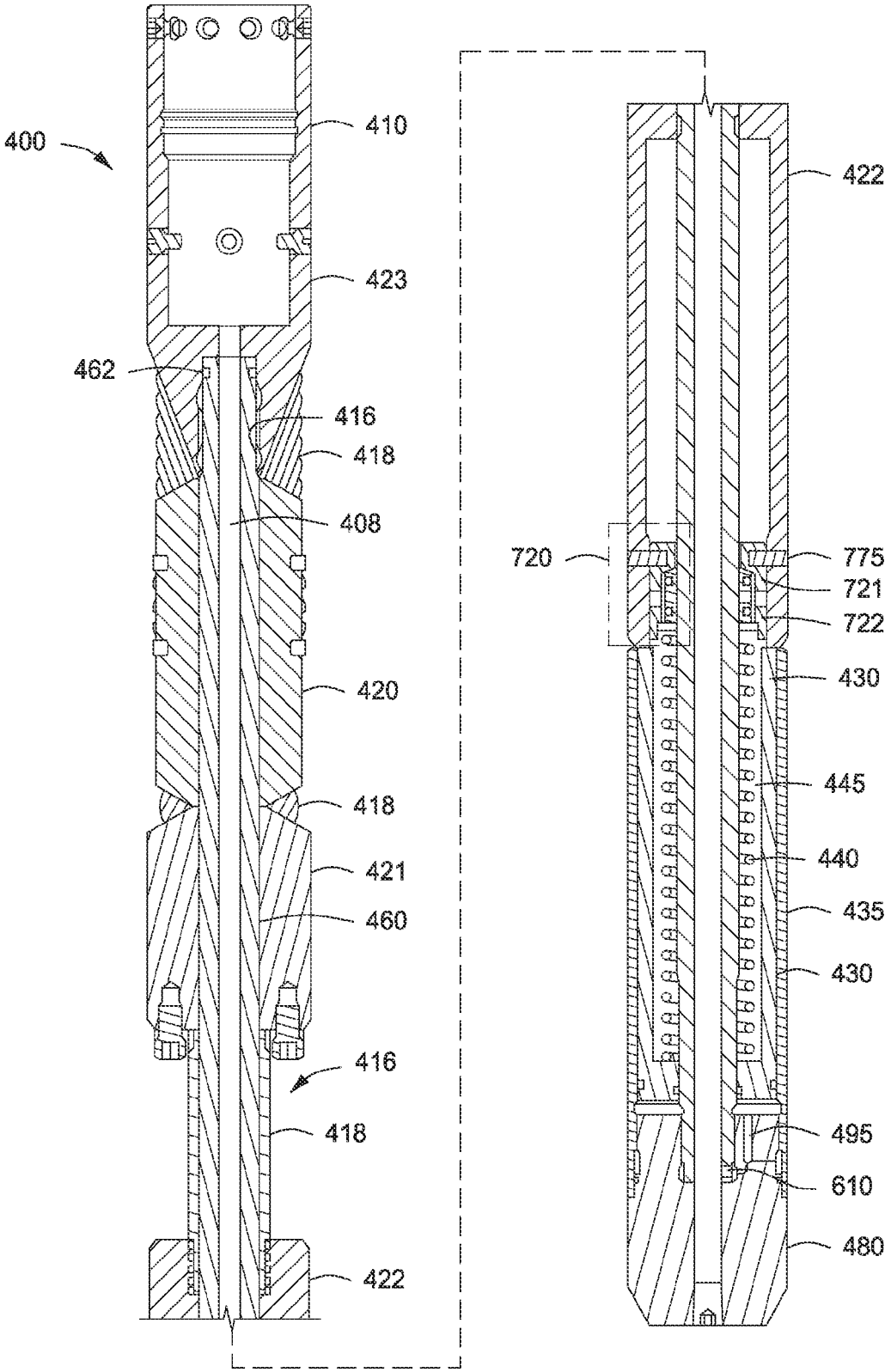
FIG. 9 depicts a cross-section view of an illustrative anchoring mechanism in a collapsed position, according to one or more embodiments disclosed.
Figure 10:
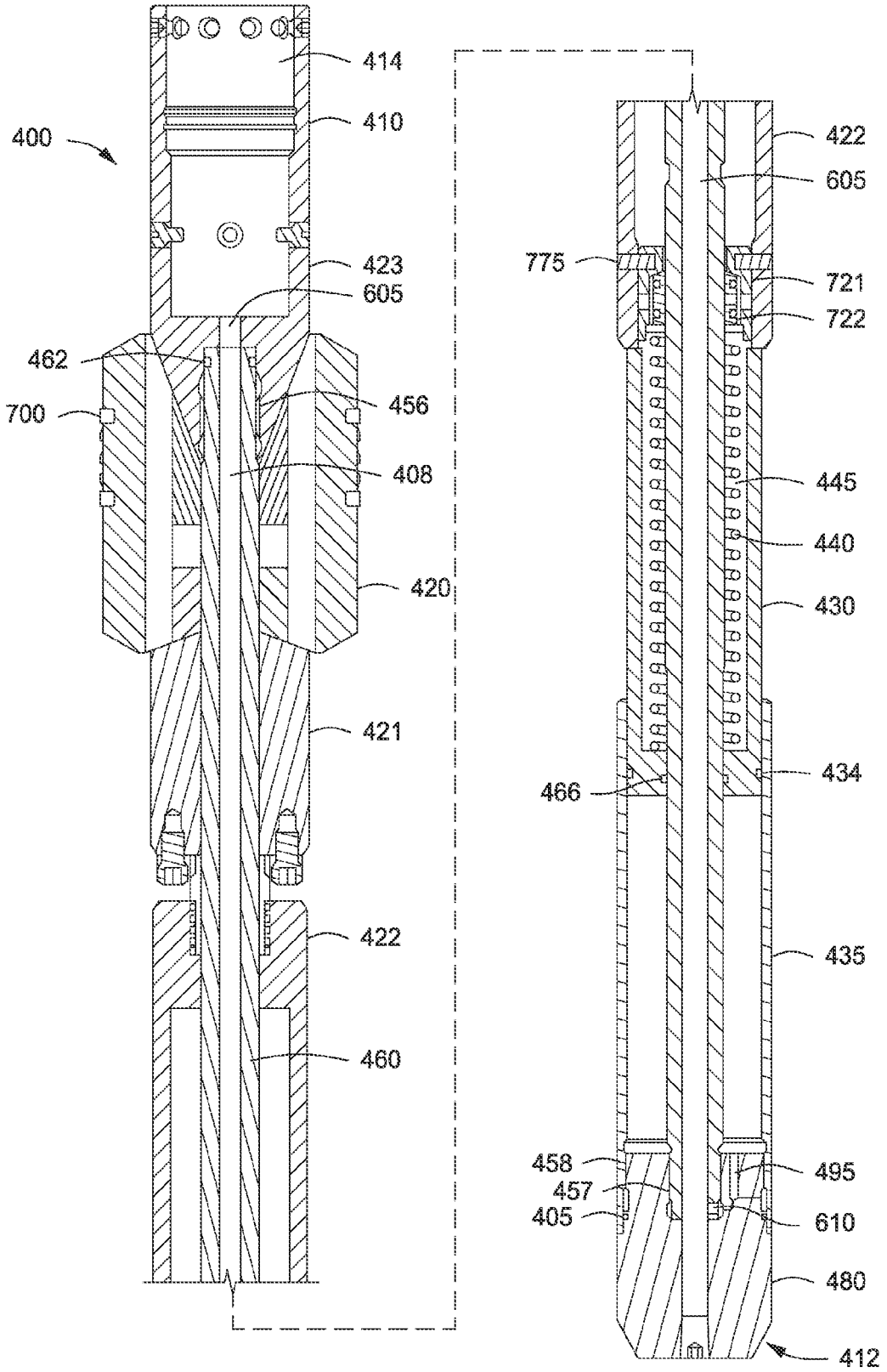
FIG. 10 depicts a cross-section view of the anchoring mechanism of FIG. 9 in an expanded position, according to one or more embodiments disclosed.

FIG. 9 depicts a cross-section view of an exemplary anchoring mechanism 400 in a collapsed position, and FIG. 10 depicts a cross-section view of the anchoring mechanism 400 in an expanded position, according to one or more embodiments. This exemplary embodiment is disclosed briefly hereinafter, however, an additional description may be found in U.S. Pat. No. 7,178,589, which is incorporated by reference herein in its entirety. Anchoring mechanism 400 may be employed as the anchoring mechanism 38 as disclosed above with reference to FIG. 1. The anchoring tool 400 includes a generally cylindrical tool body 410 with a flow bore 408 extending therethrough. The tool body 410 includes upper 414 and lower 412 connection portions for coupling the tool 400 into a downhole assembly. One or more recesses 416 are formed in the body 410. The one or more recesses 416 accommodate the radial movement of one or more moveable slips 420.

The recesses 416 further include angled channels 418 that provide a drive mechanism for the slips 420 to move radially outwardly into the expanded position of FIG. 10. A piston 430 that is contained within a piston cylinder 435 engages the lower slip housing 422. The piston 430 is adapted to move axially in the piston cylinder 435. A nose 480 provides a lower stop for the axial movement of the piston 430. A mandrel 460 is the innermost component within the tool 400, and it slidingly engages the piston 430, the lower slip housing 422, and the intermediate slip housing 421. A bias spring 440 is disposed within a spring cavity 445. An upper slip housing 423 coupled to the mandrel 460 provides an upper stop for the axial movement of intermediate slip housing 421. The nose 480 includes ports 495 that allow fluid to flow from the flow bore 408 into the piston cylinder 435 to actuate piston 430. The piston 430 sealingly engages the mandrel 460 at 466, and sealingly engages the piston cylinder 435 at 434.

In one embodiment, a threaded connection is provided at 456 between the slip housing 423 and the mandrel 460 and at 458 between the nose 480 and piston cylinder 435. A threaded connection is also provided between the nose 480 and the mandrel 460 at 457. The nose 480 sealingly engages the piston cylinder 435 at 405. The upper slip housing 423 sealingly engages the mandrel 460 at 462.

The tool 400 has two operational positions—namely a collapsed position as shown in FIG. 9 for running into the wellbore 24 (not shown) and through a restriction, and an expanded position, as shown in FIG. 10, for grippingly engaging the wellbore 24 (not shown). Hydraulic force causes the slips 420 to expand outwardly to the position shown in FIG. 10. To actuate the tool 400 and thus anchor the whipstock 22, hydraulic fluid flows through hydraulic tubing 70 (from the hydraulic actuation assembly 28, 128 shown in FIGS. 1-8), along path 605 (which is fluidly coupled to hydraulic tubing 70), through ports 495 in the nose 480, along path 610 into the piston cylinder 435. This pressure causes the piston 430 to move axially upwardly from the position shown in FIG. 9 to the position shown in FIG. 10. Therefore, differential pressure working across the piston 430 will cause the slips 420 of the tool 400 to move from a collapsed to an expanded position against the force of the biasing spring 440.

As the piston 430 moves axially upwardly, it engages the lower slip housing 422. As a result, the lower slip housing 422 engages the slips 420, which engage intermediate slip housing 421. The intermediate slip housing 421 engages the slips 420, which thereby also engage the upper slip housing 423. The slips 420*a* and 420*b* expand radially outward as they travel in channels 418 disposed in the upper, intermediate, and lower slip housings 423, 421, 422.

In at least one embodiment, the expandable anchoring tool 400 includes four slips 420. A first pair of slips, each approximately 180 degrees from each other, may be designed to extend in a first longitudinal plane, and a second pair of slips, each approximately 180 degrees from each other, and located axially below the first pair of slips, may be designed to extend in a second longitudinal plane. The angle between the first longitudinal plane and the second longitudinal plane may be about 90 degrees.

Once the slips are engaged with the wellbore 24 (e.g., the wall of the wellbore 24 or a casing) to prevent the tool 400 from returning to a collapsed position until so desired, the tool 400 may be provided with a locking means 720. In operation, downward movement of the piston 430 also acts against a lock housing 721 mounted to the mandrel 460. The lock housing 721 cooperates with a lock nut 722 which interacts with the mandrel 460 to prevent release of the tool 400 when pressure is released. The inner radial surface of the lock housing 721 includes a plurality of serrations which cooperate with the inversely serrated outer surface of locking nut 722. Similarly, the outer radial surface of the mandrel 460 includes serrations which cooperate with inverse serrations formed in the inner surface of locking nut 722. Thus, as the piston assembly causes the lock housing 721 to move downwardly, the locking nut 722 moves in conjunction therewith causing the inner serrations of the locking nut 722 to move over the serrations of the mandrel 460. The interacting edges of the serrations ensure that movement will be in one direction thereby preventing the tool 400 from returning to a collapsed position.

The anchoring tool 400 may be further arranged and designed to return from an expanded position to a collapsed position. Referring to FIG. 10, the lock housing 721 is connected to the lower slip housing 422 by shear screws 775. To return the tool 400 to the collapsed position, an axial force is applied to the tool 400, sufficient to shear the shear screws 775, thereby releasing the locking means 720.

As used herein, the terms "inner" and "outer;" "up" and "down;" "upper" and "lower;" "upward" and "downward;" "above" and "below;" "inward" and "outward;" and other like terms as used herein refer to relative positions to one another and are not intended to denote a particular direction or spatial orientation. The terms "couple," "coupled," "connect," "connection," "connected," "in connection with" and "connecting" refer to "in direct connection with" or "in connection with via another element or member." The terms "hot" and "cold" refer to relative temperatures to one another.

Although only a few example embodiments have been described in detail above, those skilled in the art will readily appreciate that many modifications are possible in the example embodiments without materially departing from "System and Method to Facilitate the Drilling of a Deviated Borehole." Accordingly, such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A system for facilitating drilling of a deviated wellbore, comprising:

a flexible line conveyance;

a hydraulic actuation assembly coupled to the flexible line conveyance, the hydraulic actuation assembly including a pump;

a separation module coupled to the whipstock and the flexible line conveyance; and a whipstock releasably coupled to the hydraulic actuation assembly, the whipstock and hydraulic actuation assembly arranged and designed to be conveyed downhole into a wellbore, the hydraulic actuation assembly providing a hydraulic fluid under pressure to anchor the whipstock in the wellbore, wherein the pump of the activation assembly is arranged and designed to be activated to pressurize the hydraulic fluid and deliver the hydraulic fluid under pressure to the separation module to release the whipstock from the flexible line conveyance.

2. The system of claim 1, wherein the flexible line conveyance is a multi-conductor wireline cable that is in electrical communication with the hydraulic actuation assembly and that withdraws the hydraulic actuation assembly from the wellbore following release of the whipstock.

3. The system of claim 1, wherein the pump is driven by a motor to pressurize the hydraulic fluid.

4. The system of claim 1, wherein the hydraulic actuation assembly comprises a firing head and an explosive material arranged and designed to pressurize the hydraulic fluid.

5. The system of claim 1, wherein the flexible line conveyance is a slickline cable that withdraws the hydraulic actuation assembly from the wellbore following release of the whipstock.

6. The system of claim 5, wherein the pump is driven by a motor to pressurize the hydraulic fluid, the motor being powered by a downhole power source.

7. The system of claim 5, wherein the hydraulic actuation assembly comprises a firing head and an explosive material arranged and designed to pressurize the hydraulic fluid.

8. The system of claim 1, further comprising a tractor coupled to the hydraulic actuation assembly to assist conveyance of the hydraulic actuation assembly into the wellbore.

9. The system of claim 1, further comprising at least one sensor coupled to the hydraulic actuation assembly, the whipstock, or both, the at least one sensor arranged and designed to sense an azimuthal orientation of the whipstock.

10. The system of claim 1, further comprising a pressure transducer coupled to the hydraulic actuation assembly, the pressure transducer measuring a pressure that is recorded to a downhole memory device or transmitted uphole.

11. The system of claim 1, wherein the hydraulic actuation assembly is coupled to hydraulic tubing, the hydraulic tubing delivering the hydraulic fluid to the whipstock for anchoring the whipstock.

12. The system of claim 1, wherein the whipstock is releasably coupled to the hydraulic actuation assembly by a shear member, the shear member being sheared to release the whipstock from the hydraulic actuation assembly.

13. The system of claim 1, further comprising an orienting device coupled to the whipstock, the orienting device arranged and designed to seat with a restraining device positioned downhole in the wellbore, the whipstock being rotated and positioned at a desired orientation within the wellbore when the orienting device is being seated with the restraining device.

14. A system for facilitating drilling of a deviated borehole, comprising:

a flexible conveyance;

a hydraulic actuation assembly coupled to the flexible conveyance, the hydraulic actuation assembly including a mandrel and a sleeve, the mandrel being movable relative to the sleeve; and a whipstock releasably coupled to the hydraulic actuation assembly, the whipstock and hydraulic actuation assembly arranged and designed to be conveyed downhole in a wellbore, the hydraulic actuation assembly:

providing a hydraulic fluid in a hydraulic fluid reservoir under pressure to anchor the whipstock at a downhole location in the wellbore prior to causing relative movement between the mandrel and the sleeve; and after anchoring the whipstock, increasing the pressure of the hydraulic fluid to release the whipstock from the hydraulic actuation assembly by causing relative movement between the mandrel and the sleeve.

15. The system of claim 14, wherein the hydraulic actuation assembly comprises a hydraulic pump driven by an electric motor.

16. The system of claim 15, wherein the electric motor is powered by electrical energy supplied by a battery.

17. The system of claim 15, wherein the electric motor is powered by electrical energy supplied via an electrical conductor routed down through the wellbore.

18. The system of claim 14, wherein the hydraulic actuation assembly comprises a firing head and an explosive material arranged and designed to pressurize the hydraulic fluid.

19. The system of claim 14, wherein the flexible conveyance is coiled tubing.

20. The system of claim 14, further comprising a tractor coupled to the hydraulic actuation assembly to assist conveyance of the hydraulic actuation assembly into the wellbore.

21. The system of claim 14, further comprising at least one sensor coupled to the hydraulic actuation assembly, the whipstock, or both, the at least one sensor arranged and designed to sense an azimuthal orientation of the whipstock.

22. The system of claim 14, further comprising a pressure transducer coupled to the hydraulic actuation assembly, the pressure transducer measuring pressure that is recorded to a downhole memory device or transmitted uphole.

23. The system of claim 14, wherein the hydraulic actuation assembly is coupled to hydraulic tubing, the hydraulic tubing delivering the hydraulic fluid to the whipstock for anchoring the whipstock prior to relative movement between the mandrel and the sleeve releasing the whipstock.

24. The system of claim 14, wherein the whipstock is releasably coupled to the hydraulic actuation assembly by a shear member, the shear member being sheared to release the whipstock from the hydraulic actuation assembly.

25. The system of claim 14, further comprising an orienting device coupled to the whipstock and operated by the hydraulic actuation assembly, the orienting device arranged and designed to seat with a restraining device positioned downhole in the wellbore, the whipstock being rotated and positioned at a desired orientation within the wellbore when the orienting device is being seated with the restraining device.

26. A method for facilitating drilling of a deviated wellbore, comprising:

conveying a whipstock downhole into a wellbore on a wireline via a hydraulic actuation assembly coupled between the whipstock and the wireline, the hydraulic actuation assembly including a pump;

pressurizing a hydraulic fluid in a hydraulic fluid reservoir for anchoring the whipstock;

hydraulically anchoring the whipstock in the wellbore; and releasing the whipstock from the wireline through activation of the pump of the hydraulic actuation assembly to deliver pressurized hydraulic fluid to a separation module for releasing the whipstock from the wireline.

27. The method of claim 26, further comprising sending a signal to a firing head disposed in the hydraulic actuation assembly to ignite an explosive material, wherein the ignition of the explosive material pressurizes a hydraulic fluid to anchor the whipstock.

28. The method of claim 26, further comprising orienting the whipstock prior to hydraulically anchoring the whipstock.

* * * * *